US009708874B2

(12) United States Patent
Uhlenberg

(10) Patent No.: US 9,708,874 B2
(45) Date of Patent: Jul. 18, 2017

(54) MECHANICAL CORE JAM INDICATOR FOR CORING TOOLS, CORING TOOLS INCLUDING SUCH CORE JAM INDICATORS, AND RELATED METHODS

(71) Applicant: Baker Hughes Incorporated, Houston, TX (US)

(72) Inventor: Thomas Uhlenberg, Niedersachsen (DE)

(73) Assignee: Baker Hughes Incorporated, Houston, TX (US)

( * ) Notice: Subject to any disclaimer, the term of this patent is extended or adjusted under 35 U.S.C. 154(b) by 412 days.

(21) Appl. No.: 14/469,743

(22) Filed: Aug. 27, 2014

(65) Prior Publication Data

US 2015/0060142 A1 Mar. 5, 2015

Related U.S. Application Data

(60) Provisional application No. 61/870,733, filed on Aug. 27, 2013.

(51) Int. Cl.
*E21B 25/00* (2006.01)

(52) U.S. Cl.
CPC ..... *E21B 25/00* (2013.01)

(58) Field of Classification Search
CPC ..... E21B 10/48
See application file for complete search history.

(56) References Cited

U.S. PATENT DOCUMENTS 2,503,561 A * 4/1950 Pickard ..... E21B 10/48 175/255
2,532,716 A * 12/1950 Havlick ..... E21B 25/00 175/249
2,791,398 A * 5/1957 O'Reilly ..... E21B 25/04 175/249
4,735,269 A 4/1988 Park et al.
(Continued)

FOREIGN PATENT DOCUMENTS

WO 9202707 A2 2/1992

OTHER PUBLICATIONS

International Preliminary Report on Patentability for International Application No. PCT/US2014/052901, date of issuance: Mar. 1, 2016. 7 pages.

(Continued)

*Primary Examiner* — Wei Wang
(74) *Attorney, Agent, or Firm* — TraskBritt

(57) ABSTRACT

Core jam indicators for use with coring tools include a plug coupled with an inner barrel and configured to selectively close the entrance of the inner barrel. The plug has at least one fluid port extending through a wall of the plug between an interior and an exterior of the plug. The mandrel at least partially covers the at least one fluid port of the plug in an activated position and the at least one fluid port is at least partially uncovered by the mandrel in a deactivated position. The mandrel is coupled to the inner barrel. A piston force acting on the mandrel resulting from a pressure difference above and below the mandrel acts over an area smaller than a maximum transverse cross-sectional area of the inner barrel. Coring tools include such core jam indicators. Components are provided and assembled to form such core jam indicators.

20 Claims, 12 Drawing Sheets

(56) References Cited

U.S. PATENT DOCUMENTS

| | | | |
|---|---|---|---|
| 8,397,820 | B2 | 3/2013 | Fehr et al. |
| 2008/0156537 | A1 | 7/2008 | Stockton |
| 2011/0247879 | A1 | 10/2011 | Johnston et al. |

OTHER PUBLICATIONS

International Search Report for International Patent Application PCT/US2014/052901, mailing date Dec. 8, 2014, 3 pages.
International Written Opinion for International Application No. PCT/US2014/052901, mailing date: Dec. 8, 2014, 6 pages.

* cited by examiner

| | Density | Fann Readings at given rpm [lb/100 ft2] | | | | | | Plastic Viscosity | Yield Point | Gel Strength | |
|---|---|---|---|---|---|---|---|---|---|---|---|
| | | | | | | | | PV | YP | 10 s | 10 min |
| | [ ppg ] | 600 | 300 | 200 | 100 | 6 | 3 | [ cp ] | [lb/100 ft2] | [lb/100 ft2] | [lb/100 ft2] |
| **Mud A** | 16,5 | 58 | 36 | 28 | 18 | 5 | 4 | 22 | 14 | 2 | 6 |
| **Mud B** | 15,5 | 63 | 39 | 40 | 19 | 6 | 5 | 24 | 15 | 3 | 6 |
| **Mud C** | 14,8 | 91 | 58 | 44 | 30 | 14 | 12 | 33 | 25 | 11 | 25 |
| **Mud D** | 14,6 | 151 | 82 | 56 | 31 | 4 | 3 | 69 | 13 | 4 | 10 |
| **Mud E** | 13,5 | 45 | 28 | 17 | 13 | 6 | 5 | 17 | 11 | 9 | 25 |
| **Mud F** | 13,5 | 93 | 55 | 40 | 24 | 6 | 5 | 38 | 17 | 4 | 7 |
| **Mud G** | 12,3 | 54 | 31 | 23 | 14 | 3 | 2 | 23 | 8 | 6 | 4 |
| **Mud H** | 10,4 | 61 | 41 | 38 | 28 | 9 | 8 | 20 | 21 | 8 | 16 |

*FIG. 7*

MECHANICAL CORE JAM INDICATOR FOR CORING TOOLS, CORING TOOLS INCLUDING SUCH CORE JAM INDICATORS, AND RELATED METHODS

CROSS-REFERENCE TO RELATED APPLICATION

This application claims the benefit of U.S. Provisional Patent Application Ser. No. 61/870,733, filed Aug. 27, 2013, the disclosure of which is hereby incorporated herein in its entirety by this reference.

FIELD

The disclosure relates generally to core jam indicators used in conjunction with coring tools for obtaining core samples from earth formations penetrated by a wellbore. Core jam indicators indicate to an operator that a core sample has become jammed within the coring tool during a coring operation. The disclosure also relates to coring tools that include such core jam indicators, and to methods of making and using such core jam indicators and coring tools.

BACKGROUND

When evaluating an earth formation, a core sample from the earth formation may be procured using a bottom hole assembly often referred to in the art as a "coring tool." A coring tool may include a core bit, which is often a hollow earth-boring rotary drill bit having a longitudinal aperture extending through the center thereof. As a result, when the core bit drills through the formation, a core sample is formed within the longitudinal aperture extending through the center of the core bit. An inner barrel may then be positioned within an outer tubular member, commonly termed a "core barrel" of the coring tool above the core bit, and is configured and positioned to receive the core sample therein as the core sample is formed by the core bit as the core bit drills into the earth formation and the coring tool lowers around the core sample.

During a coring operation, as the core sample is being formed by the core bit and the inner barrel progressively slides downward over the core sample within the coring tool, the core sample may jam rotationally, longitudinally, or both inside the inner barrel. Continued drilling by the core bit when the core sample has jammed inside the inner barrel often results in damage to the core sample, and information regarding characteristics of the earth formation being cored that might otherwise have been obtained from the damaged portion of the core sample is lost.

In an effort to mitigate the effects of such core jams, tools have been developed for use in conjunction with, or as part of, a coring tool that indicate to an operator of the coring tool at the surface of the formation that a core jam has occurred, which allows the operator to attempt to address the issue without causing further damage to the core sample. Some such core jam indicators are mechanical core jam indicators that provide a signal to the operator in the form of an increase in the hydraulic standpipe pressure within the drill string above the coring tool. For example, some previously known mechanical core jam indicators rely on mechanical movement of parts within the core jam indicator induced by a jam between the core sample and the inner barrel. The mechanical movement of parts causes a restriction in a flow area through which hydraulic fluid (e.g., drilling mud) flowing through the tool during the coring operation may pass. The restriction in the flow area results in an increase in the hydraulic standpipe pressure, which is detected by the operator to indicate the presence of the core jam.

Previously known mechanical core jam indicators, however, often require relatively high weight-on-bit for proper operation and, thus, were not usable in some coring operations due to the inability to provide sufficient weight-on-bit. In addition, in previously known mechanical core jam indicators, the increase in the standpipe pressure caused by the core jam indicator responsive to a core jam resulted in application of undesirable hydraulic forces to components of the core jam indicator, which tended to counteract the movement of the mechanical components of the core jam indicator. As a result, a weight-on-bit sufficient to allow initiation of movement of the components of the core jam indicator might not be sufficient to result in complete movement of the components and generation of the pressure change signal in the hydraulic standpipe pressure. This is especially the case in applications where it might be desirable to apply only a limited amount of weight-on-bit.

BRIEF SUMMARY

In some embodiments, the present disclosure includes a core jam indicator for use with a coring tool for obtaining a core sample from a subterranean formation. The core jam indicator includes a plug coupled with an inner barrel, the plug being configured to selectively close the entrance of the inner barrel, the plug having at least one fluid port extending through a wall of the plug between an interior and an exterior of the plug, an anchor member operably associated with the plug, and a mandrel having an upper end and a lower end. The mandrel is configured to move between a deactivated position and an activated position. The mandrel at least partially covers the at least one fluid port of the plug in the activated position to impede fluid flow through the at least one fluid port, and the at least one fluid port is at least partially uncovered by the mandrel in the deactivated position to facilitate fluid flow through the at least one fluid port. The mandrel is coupled to the inner barrel of the coring tool such that movement of the inner barrel results in movement of the mandrel. A piston force acting on the mandrel resulting from a pressure difference above and below the mandrel acts over an area smaller than a maximum transverse cross-sectional area of the inner barrel.

In additional embodiments, a coring tool for use in obtaining a core sample from an earth formation within a wellbore includes a core bit, an outer tubular member coupled to the core bit and an inner barrel pivotally secured within the outer tubular member above the core bit. The inner barrel is configured to receive a formation core sample therein as the core sample is formed by the core bit as the core bit drills through an earth formation. A core jam indicator is configured to generate a pressure signal detectable by an operator of the coring tool responsive to a jam between a formation core sample and the inner barrel as the core sample is formed by the core bit and received within the inner barrel. The core jam indicator includes a plug coupled with the inner barrel, the plug being configured to selectively close the entrance of the inner barrel, the plug having at least one fluid port extending through a wall of the plug between an interior and an exterior of the plug. The core jam indicator also includes an anchor member operatively associated with the plug, and a mandrel having an upper end and a lower end. The mandrel is configured to move between a deactivated position and an activated position. The mandrel at least partially covers the at least one fluid port of the plug in the activated position to impede fluid flow through the at least one fluid port, and the at least one fluid port is at least partially uncovered by the mandrel in the deactivated position to facilitate fluid flow through the at least one fluid port. The mandrel is coupled to an inner barrel of the coring tool such that movement of the inner barrel results in movement of the mandrel. A piston force acting on the mandrel resulting from a pressure difference above and below the mandrel acts over an area smaller than a maximum transverse cross-sectional area of the inner barrel.

In still other embodiments, the present disclosure includes a method of forming a core jam indicator for use with a coring tool for obtaining a core sample from a subterranean formation. The method includes coupling a plug with an inner barrel, the plug having at least one fluid port extending through a wall of the plug between an interior and an exterior of the plug. The method also includes operatively associating an anchor member with the inner barrel and disposing a mandrel proximate the plug. The mandrel has an upper end and a lower end, and the mandrel is configured to move between a deactivated position and an activated position. The mandrel at least partly covers the at least one fluid port of the plug in the activated position to impede fluid flow through the at least one fluid port, and the at least one fluid port of the tubular plug is at least partly uncovered by the mandrel in the deactivated position to facilitate fluid flow through the at least one fluid port. The method includes coupling an inner barrel of a coring tool to the mandrel such that movement of the inner barrel results in movement of the mandrel from the deactivated position to the activated position, restriction of fluid flow through the at least one fluid port extending through the wall of the plug, and an increase in a hydraulic pressure within the plug.

BRIEF DESCRIPTION OF THE DRAWINGS

While the disclosure concludes with claims particularly pointing out and distinctly claiming embodiments of the invention, various features and advantages of core jam indicators, coring tools including such core jam indicators, and related methods, as disclosed herein, may be more readily ascertained from the following description when read in conjunction with the accompanying drawings, in which:

FIG. 7 is a table of physical properties for eight different examples of drilling muds;

DETAILED DESCRIPTION

The illustrations presented herein are not meant to be actual views of any particular core jam indicator, coring tool, or component thereof, but are merely idealized representations employed to describe illustrative embodiments. The figures are not necessarily drawn to scale.

Figure 1:
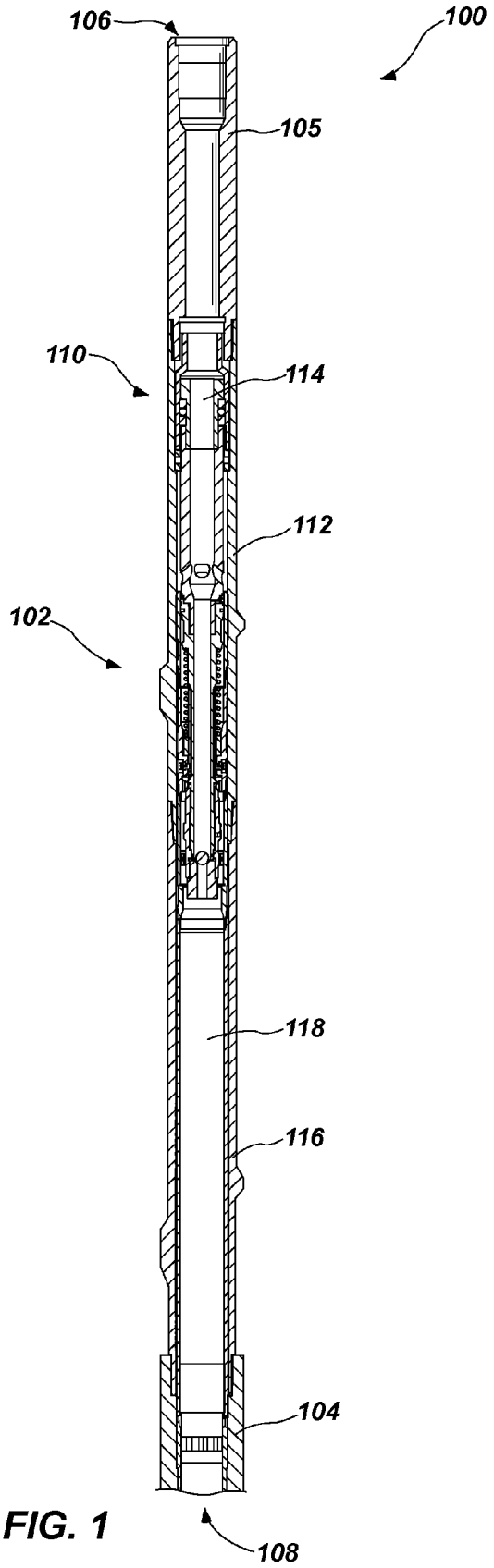
FIG. 1 is a longitudinal cross-sectional view of a coring tool including a core jam indicator and a core bit.

FIG. 1 is a longitudinal cross-sectional view of a coring tool 100 that includes a core jam indicator 102 and a core bit 104. The coring tool 100 has a coupling member 105 at an upper, proximal end 106, and the core bit 104 is disposed at a lower, distal end 108 of the coring tool 100. The coupling member 105 at the upper, proximal end 106 is configured to couple the coring tool 100 to another component of a drill string, and may be or include a part of, a swivel member 110.

The swivel member 110 includes an outer tubular member 112 that is fixedly coupled to the coupling member 105, such that the outer tubular member 112 rotates in unison with rotation of the coupling member 105 caused by rotation of the drill string. The swivel member 110 also includes an inner assembly 114 supported within the outer tubular member 112 by bearings such that the inner assembly 114 is rotationally decoupled from the outer tubular member 112. Thus, the inner assembly 114 may remain rotationally stationary during rotation of the drill string, coupling member 105, and the outer tubular member 112.

The core bit 104 at the lower, distal end 108 of the coring tool 100 may comprise any type or configuration of core bit 104. The core bit 104 is coupled to the outer tubular member 112 of the swivel member 110 by an outer barrel 116 comprising one or more tubular segments coupled end-to-end, such that rotation of the outer tubular member 112 of the swivel member 110 (by rotation of the drill string) causes rotation of the core bit 104.

As the core bit 104 is rotated in a coring operation, a generally cylindrical core sample of the formation being drilled is formed within a central opening in the core bit 104. As the core bit 104 drills through the formation and forms the core sample from uncut formation material within the center of the core bit 104, the core sample advances into and relatively upward through the core bit 104 by way of the central opening and into an inner barrel 118 disposed within the outer barrel 116. The inner barrel 118 also may comprise one or more tubular segments coupled end-to-end.

During normal operation, the coring operation will continue until a core sample of desirable length has been formed by the core bit 104 and received within the inner barrel 118. In some instances, however, the core sample being formed may jam inside the inner barrel 118. In the event of such a core jam, further coring often results in damage or destruction of the core sample due to compressive and/or torsional forces acting on the core sample. Thus, the coring tool 100 includes the core jam indicator 102, which may be coupled at its lower distal end to the inner barrel 118 and at its upper proximal end to the inner assembly 114 of the swivel member 110. As discussed in further detail below, in the event of a core jam, the jammed core sample will exert an upward force on the inner barrel 118, which causes movement of one or more components within the core jam indicator 102, and a resulting increase in hydraulic pressure within a portion of the coring tool 100 and the drill string, which can be detected by an operator of the coring tool 100.

Figure 2:
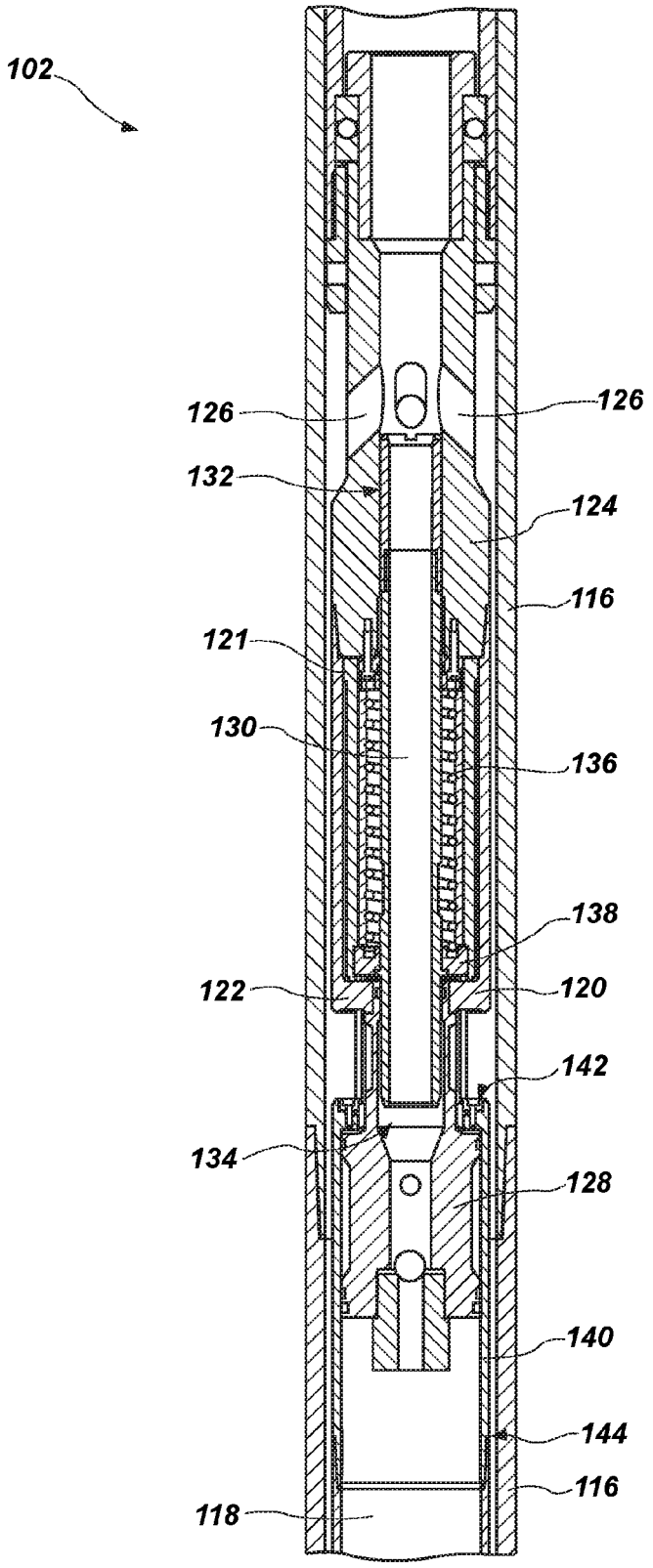
FIG. 2 is an enlarged view of a portion of FIG. 1 illustrating components of the core jam indicator within the coring tool.

FIG. 2 is an enlarged view of the core jam indicator 102 of the coring tool 100 of FIG. 1. The core jam indicator 102 includes a generally tubular housing 120 having an upper end 121 and a lower end 122. The core jam indicator 102 also includes a generally tubular plug 124 coupled with the upper end 121 of the housing 120. The plug 124 has at least one fluid port 126 extending through a wall of the plug 124 connecting the interior and an exterior of the inner barrel 118. The core jam indicator 102 further includes a generally tubular anchor member 128 fixedly coupled with the lower end 122 of the housing 120. As can be seen in FIG. 2, a cross-sectional area of a fluid passageway through the anchor member 128 may be reduced within the anchor member 128, for reasons discussed in further detail below.

A generally tubular mandrel 130 having an upper end 132 and a lower end 134 is disposed within the housing 120 and at least partially within the plug 124, as shown in FIG. 2. The mandrel 130 is configured to slide up and down between a deactivated position (shown in FIG. 5) and an activated position (shown in FIG. 6). As discussed in further detail below, the mandrel 130 covers at least partly the one or more fluid ports 126 in the plug 124 when the mandrel 130 is in the activated position (FIG. 6) to impede fluid flow through the one or more fluid ports 126, but the one or more fluid ports 126 of the tubular plug 124 are uncovered at least partly by the mandrel 130 when the mandrel 130 is in the deactivated position (FIG. 5) to facilitate fluid flow through the one or more fluid ports 126.

With continued reference to FIG. 2, the coring tool 100 further may include a spring member 136 that is located and configured to bias the mandrel 130 to the deactivated position. As shown in FIG. 2, the spring member 136 may comprise a metal coil spring. The housing 120 may be fixedly attached to the plug 124. For example, the upper end 121 of the housing 120 may be threaded onto the plug 124, such that the relatively longitudinal movement between the housing 120 and the plug 124 is precluded when they are secured together. A collar member 138 may be attached to an outer surface of the mandrel 130 at a fixed longitudinal position along the mandrel 130, and the spring member 136 may act between the lower end of the plug 124 and the collar member 138 so as to bias the collar member 138 and the mandrel 130 to which it is attached in the downward, deactivated position.

A generally tubular connector member 140 is positioned circumferentially around the anchor member 128, and is configured to slide up and down along the anchor member 128. The connector member 140 has an upper end 142 and a lower end 144 and the lower end 144 is configured to be coupled to the inner barrel 118 of the coring tool 100 in which a core sample may be received during a coring operation. The connector member 140 is coupled to the mandrel 130 such that movement of the connector member 140 responsive to movement of the inner barrel 118 attached thereto caused by a core jam results in movement of the mandrel 130 from the downward, deactivated position (shown in FIGS. 2 and 5) to the upward, activated position (shown in FIG. 6). As the connector member 140 and mandrel 130 move upward responsive to a core jam, the upper end 132 of the mandrel 130 covers at least partly the one or more fluid ports 126 in the plug 124 and restricts fluid flow through the one or more fluid ports 126, which results in an increase in hydraulic pressure within the plug 124 (and elsewhere in the coring tool 100 and drilling assembly to which the coring tool 100 is attached) that may be detected by an operator. In some embodiments, the connector member 140 may be integral with the inner barrel 118. Thus, at least a portion of the inner barrel 118 may be characterized as a connector member.

Figure 3:
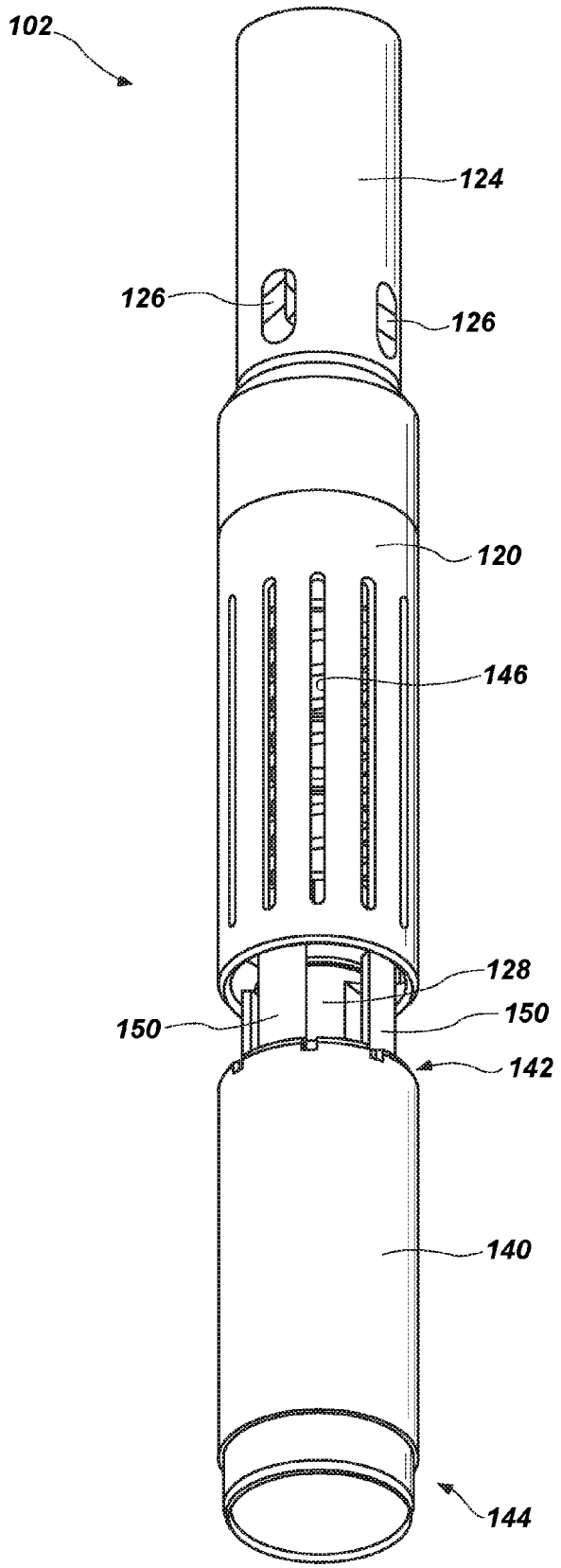
FIG. 3 is a perspective view of the core jam indicator of the coring tool of FIG. 1 separate from the other components of the coring tool.
Figure 4:
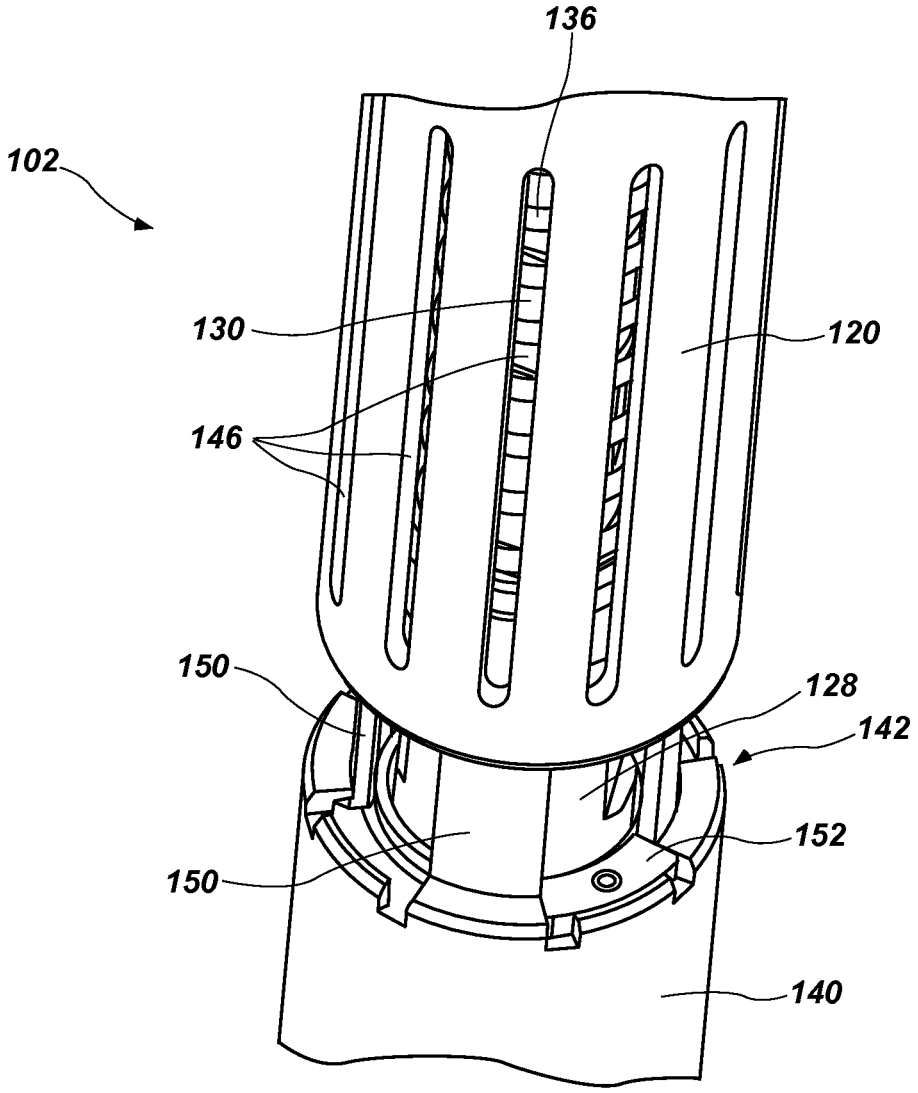
FIG. 4 is a partial, enlarged perspective view of the core jam indicator.

FIGS. 3 and 4 are perspective views of components of the core jam indicator 102 of the coring assembly 100 of FIG. 1. As can be seen in FIGS. 3 and 4, one or more apertures 146 may be formed through the wall of the tubular housing 120. The spring member 136 is disposed between an inner surface of the tubular housing 120 and an outer surface of the mandrel 130, and the spring member 136 may be exposed to the exterior of the core jam indicator 102 by the apertures 146. In other words, the apertures 146 provide fluid communication between an exterior of the housing 120 and an interior of the housing 120, facilitating fluid flowing over the exterior of the housing 120 to enter into the volume of space between the housing 120 and the mandrel 130 in which the spring member 136 is disposed, which may facilitate flushing of sediment and other debris out from the vicinity of the spring member 136, resulting in smoother operation of the core jam indicator 102 and potentially a longer service life.

With continued reference to FIGS. 3 and 4, the upper end 142 of the connector member 140 may be coupled to the mandrel 130 using an intermediate push member 150 therebetween. For example, the push member 150 may be a generally tubular cage structure having longitudinal extensions (visible in FIGS. 3 and 4) that are separated from one another by gaps. An upper end of the push member 150 may be disposed within the housing 120 and may abut against a lower surface of the collar member 138 (FIG. 2) that is fixedly attached to the mandrel 130. The lower ends of the longitudinal extensions of the push member 150 may include features that interlock with complementary features formed in the upper end 142 of the connector member 140, e.g., by using a bayonet-type connection upon alignment and relative rotation between the push member 150 and the connector member 140. After the push member 150 has been mechanically interlocked with the upper end 142 of the connector member 140, one or more locking members 152 may be bolted or otherwise attached to the upper end 142 of the connector member 140. The locking members 152 may project into the gaps between the longitudinal extensions of the push member 150, thereby preventing relative rotation between the push member 150 and the connector member 140 in any way that would decouple the interconnection (e.g., the bayonet-type interconnection) therebetween.

Figure 6:
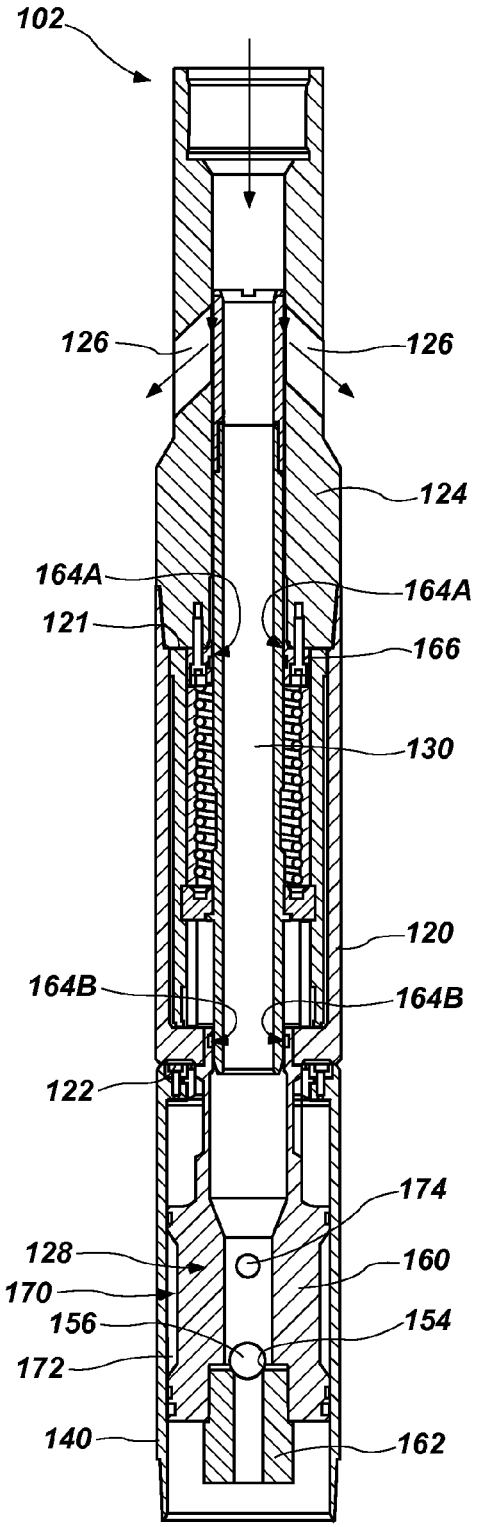
FIG. 6 is a longitudinal cross-sectional view like that of FIG. 5 illustrating the core jam indicator in a jammed configuration.
Figure 5:
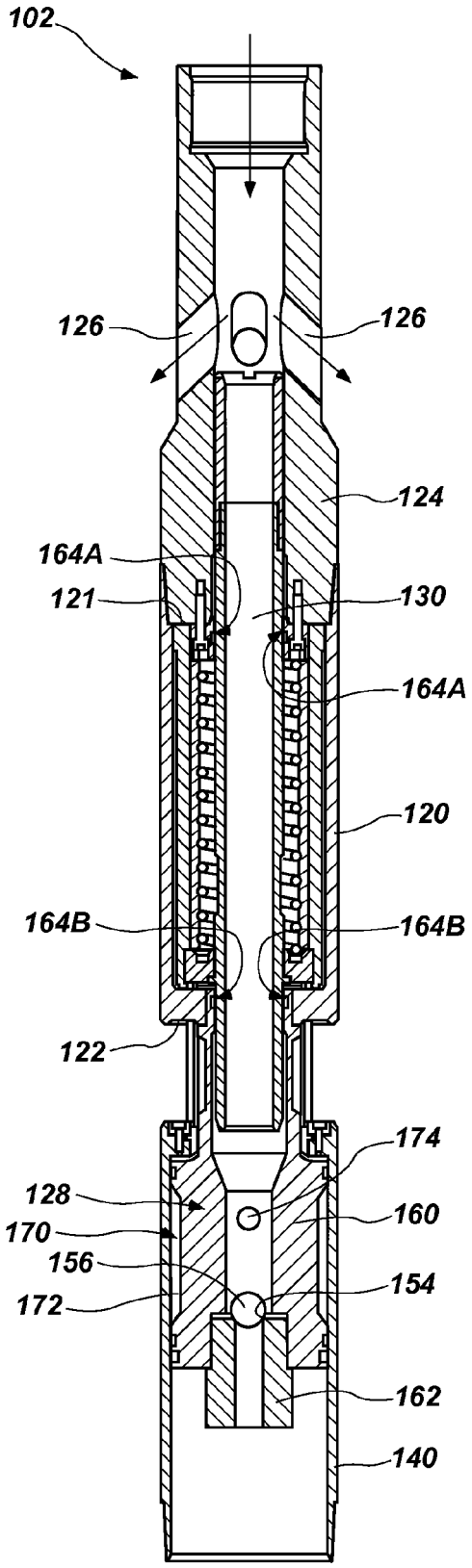
FIG. 5 is a longitudinal cross-sectional view of the core jam indicator in a normal unjammed configuration.

FIG. 5 is similar to FIG. 2 and illustrates the core jam indicator 102 in a normal unjammed configuration in which the mandrel 130 is in the downward, deactivated position, while FIG. 6 illustrates the core jam indicator 102 in a jammed configuration in which the mandrel 130 is in the upward, activated position. As previously discussed, the fluid ports 126 of the tubular plug 124 are at least partially uncovered by the mandrel 130 when the mandrel 130 is in the deactivated position of FIG. 5, which facilitates fluid pumped through the plug 124 to flow through the fluid ports 126 and into the annular space between the core jam indicator 102 and the outer barrel 116 (FIG. 1), but the mandrel 130 covers at least partly the fluid ports 126 in the plug 124 when the mandrel 130 is in the activated position of FIG. 6 so as to impede fluid flow through the fluid ports 126, which results in an increase in the fluid pressure within the plug 124 and elsewhere in the downhole assembly that can be detected by a user to detect a core jam.

As previously mentioned, the cross-sectional area of the fluid passageway extending through the plug 124, the mandrel 130, and the anchor member 128 may be reduced within the anchor member 128. In some embodiments, the anchor member 128 may include a ball seat surface 154 that is sized and configured to retain a ball member 156 within the anchor member 128 during a coring operation. In some embodiments, the anchor member 128 may include a main body 160 and a pressure relief plug 162 coupled to the main body 160, and at least a portion of the ball seat surface 154 may comprise a surface of the pressure relief plug 162.

In some embodiments, prior to initiating a coring operation, drilling fluid may flow through the core jam indicator 102 through the interior of each of the plug 124, the mandrel 130, and the anchor member 128. In this configuration, a flow of drilling fluid may flush the inner barrel 118 (FIG. 1) clean. Upon initiating a coring operation, the ball member 156 may be dropped through the drill string and come to rest on the ball seat surface 154, thus blocking the flow of fluid through the anchor member 128 and protecting the core sample within the inner barrel 118 from the drilling fluid flow.

Previously known mechanical core jam indicators include such a ball seat surface carried by the mandrel and located proximate the upper end of the mandrel. As a result, in such previously known mechanical core jam indicators, the hydraulic pressure above the ball seat surface applies a piston force on the ball and the mandrel. Such a piston force acting on the mandrel may result in a higher weight-on-bit required for proper operation of the core jam indicator, and the use of such core jam indictors may be restricted to relatively high weight-on-bit applications.

In contrast to such previously known designs, the core jam indicator 102 of the coring tool 100 (FIG. 1) of the present disclosure may be configured such that the piston force required to initiate the movement of the mandrel from the deactivated to the activated position is significantly lower (e.g., eliminated). For example, as has been previously discussed, the ball seat surface 154 may be placed longitudinally below the mandrel 130 on a stationary, non-moving component of the core jam indicator 102, such as the anchor member 128, which is fixedly coupled with the lower end 122 of the tubular housing 120. As shown in FIGS. 5 and 6, the mandrel 130 may be supported within the core jam indicator 102 by a first bearing surface 164A located proximate the upper end 121 of the tubular housing 120, and a second bearing surface 164B located proximate the lower end 122 of the tubular housing 120. For example, the first bearing surface 164A may comprise an inner cylindrical surface of a guide flange member 166. The guide flange member 166 may be bolted or otherwise coupled to a lower end surface of the plug 124, and may be configured to retain the spring member 136 within the housing 120. The second bearing surface 164B may comprise an inner cylindrical surface of the anchor member 128 that is received within the lower end 122 of the tubular member 120, as shown in FIGS. 5 and 6. One or more fluid seals may be provided between the bearing surfaces 164A, 164B and the outer surface of the mandrel 130 using, for example, polymeric, metal, or ceramic seal members disposed at the interface therebetween. The diameter of the seals at both the first bearing surface 164A and the second bearing surface 164B may be at least substantially the same. In this configuration, the total fluid pressure difference within the fluid passageway above and below the mandrel 130 may be at least substantially the same as the hydrostatic pressure difference, and any upward and downward piston forces applied to the mandrel 130 by the fluid pressure may be substantially the same, resulting in a net zero applied piston force on the mandrel 130. In other words, a piston force resulting from fluid pressure acting on the mandrel 130 may include a component of force urging the mandrel 130 upward and an equal and opposite component of force urging the mandrel 130 downward. The lack of any net piston force on the mandrel 130 may reduce the threshold minimum weight-on-bit required for proper operation of the coring jam indicator 102, and may improve the consistency of operation of the core jam indicator 102.

The core jam indicator 102 may be further configured such that a piston force acting on the connector member 140 is defined by a pressure differential between an exterior of the connector member 140 and the inner barrel 118 attached thereto (FIG. 1) applied to a transverse cross-sectional area of the cylindrical wall of the connector member 140. In contrast, previously known mechanical core jam indicators of similar design are configured such that the piston force acting on the connector member thereof is defined by the pressure differential between the exterior of the connector member (and the inner barrel attached thereto) applied to the entire circular area encompassed by the outer diameter of the connector member, and not just the transverse cross-sectional area of the cylindrical wall of the connector member, as in the core jam indicator 102 described herein. Such previously known mechanical core jam indicators of similar design do not include any anchor member 128 as described herein that is fixedly coupled to the lower end of the housing 120 and disposed within the interior of the connector member 140 to support the connector member 140 thereon. Thus, the core jam indicator is configured such that a larger portion of the hydraulic piston forces act on stationary components of the core jam indicator 102, such as the plug 124, housing 120, and anchor member 128, rather than on moveable components of the core jam indicator 102, such as the mandrel 130 and the connector member 140.

In some embodiments, the anchor member 128 may include a recess 170 in an outer side surface of the anchor member 128 that defines a fluid cavity 172 between the outer side surface of the anchor member 128 and an inner surface of the connector member 140. One or more fluid ports 174 may be formed that extend through the wall of the anchor member 128 between an interior of the anchor member 128 longitudinally above the ball seat surface 154 and the ball member 156 and the fluid cavity 172 between the outer side surface of the anchor member 128 and the inner surface of the connector member 140. By allowing the drilling fluid (e.g., mud) to enter the fluid cavity 172, the friction between the anchor member 128 and the connector member 140 may be reduced. The fluid cavity 172 may also serve to inhibit sedimentation of solids within the drilling fluid, as fluid is allowed to flow through cavity 172 and anchor member 128 to flush sediment and other debris from the anchor member 128.

As known to those of ordinary skill in the art, the force acting on the connector member 140 and the mandrel 130 in the upward direction required to initiate movement of the mandrel 130 from the deactivated position (FIG. 5) to the activated position (FIG. 6), which is referred to herein as the core jam indication (CJI) force, is a function of many variables, some of which relate to the design and configuration of the core jam indicator 102 as previously discussed, and others of which relate to the properties of the drilling fluid, or "mud" that is pumped through the coring tool 100 and the core jam indicator 102 during operation. The difference in the fluid pressure within the core jam indicator 102 above the mandrel 130 (and elsewhere in the downhole assembly) when the mandrel 130 is the activated position (FIG. 6) compared to when the mandrel 130 is in the deactivated position (FIG. 5) is the pressure "signal" that is detectable by an operator to identify a core jam. The magnitude of the pressure signal (i.e., the magnitude of the difference in the fluid pressure) is also a function of variables relating to the design and configuration of the coring tool and the core jam indicator and variables relating to the properties of the drilling mud. The magnitudes of the CJI force and the pressure signal are also a function of the flow rate of the drilling mud through the coring tool 100 and the core jam indicator 102, since the flow rate is directly related to the fluid pressures at different locations within the core jam indicator 102.

Figure 8:
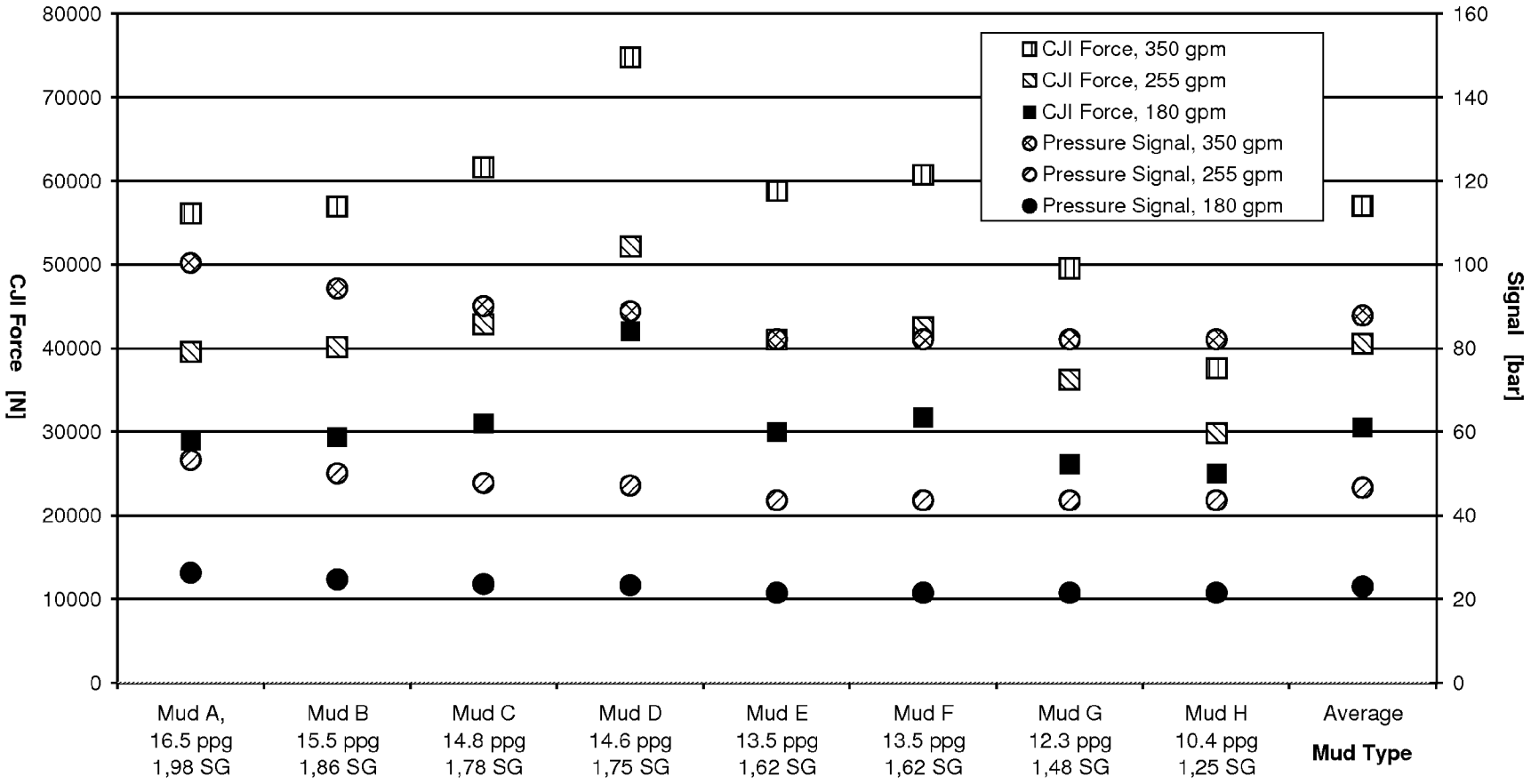
FIG. 8 is a plot illustrating a calculated magnitude of a core jam indication force and a magnitude of a pressure signal generated by the core jam indicator for each of the examples of drilling muds listed in the table of FIG. 7.

FIG. 7 is a table of various physical properties relating to eight (8) common, commercially available drilling muds (Mud A through Mud H). FIG. 8 is a graph illustrating the calculated magnitude of the CJI force (in Newtons) and the calculated magnitude of the pressure signal (in bars) for an embodiment of a core jam indicator 102 as described herein at each of three different flow rates of drilling mud through the core jam indicator (180 gpm, 255 gpm, and 350 gpm). The graph was generated using a computer generated model of the core jam indicator 102 and computer software for calculating the magnitudes of the CJI force and the signal pressure using the computer generated model, and variables relating to the various drilling muds and flow rates. As shown at the far right of the graph, the various calculated CJI forces and pressure signals for each of the drilling muds were averaged.

As shown in FIG. 8, embodiments of core jam indicators 102 as described herein may exhibit a CJI force of about 75,000 N or less, about 60,000 N or less, or even about 50,000 or less, at a flow rate of 350 gpm. Embodiments of core jam indicators 102 as described herein may exhibit an average CJI force of about 58,000 N or less at a flow rate of 350 gpm. Embodiments of core jam indicators 102 as described herein may exhibit a CJI force of about 55,000 N or less, about 50,000 N or less, or even about 45,000 or less, at a flow rate of 255 gpm. Embodiments of core jam indicators 102 as described herein may exhibit an average CJI force of about 40,000 N or less at a flow rate of 255 gpm. Embodiments of core jam indicators 102 as described herein may exhibit a CJI force of about 45,000 N or less, about 35,000 N or less, or even about 30,000 or less, at a flow rate of 180 gpm. Embodiments of core jam indicators 102 as described herein may exhibit an average CJI force of about 30,000 N or less at a flow rate of 180 gpm.

As is also shown in FIG. 8, embodiments of core jam indicators 102 as described herein may exhibit a pressure signal of at least about 80 bar, at least about 85 bar, or even at least about 90 bar, at a flow rate of 350 gpm. Embodiments of core jam indicators 102 as described herein may exhibit an average pressure signal of at least about 88 bar at a flow rate of 350 gpm. Embodiments of core jam indicators 102 as described herein may exhibit a pressure signal of at least about 40 bar, at least about 45 bar, or even at least about 50 bar, at a flow rate of 255 gpm. Embodiments of core jam indicators 102 as described herein may exhibit an average pressure signal of at least about 42 bar at a flow rate of 255 gpm. Embodiments of core jam indicators 102 as described herein may exhibit a pressure signal of at least about 15 bar, at least about 20 bar, or even at least about 22 bar, at a flow rate of 180 gpm. Embodiments of core jam indicators 102 as described herein may exhibit an average pressure signal of at least about 22 bar at a flow rate of 180 gpm.

The weight and length of the inner barrel 118 of the coring tool 100 that is attached to the connector member 140 of the core jam indicator 102 also may affect the magnitude of the CJI force and the magnitude of the pressure signal of the core jam indicator 102. The graph of FIG. 8 was generated using variables based on a steel inner barrel 118 having a nominal barrel length of 360 ft.

Figure 9:
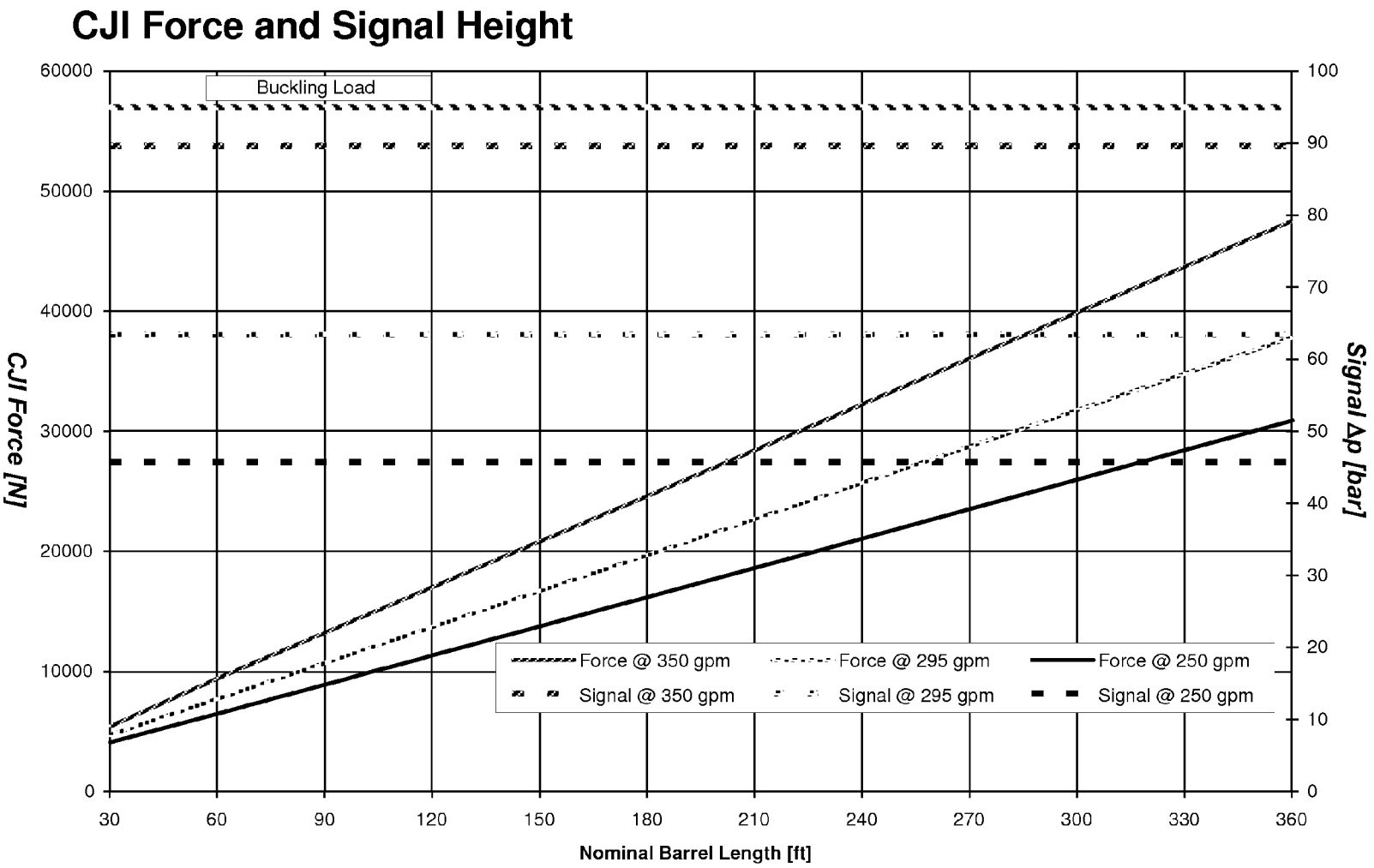
FIG. 9 is a graph illustrating the calculated magnitude of a core jam indication force and a calculated magnitude of a pressure signal generated by the core jam indicator as a function of a length of the inner barrel of the coring tool for an average drilling mud at three different rates of flow of the average drilling mud through the coring tool.

The graph of FIG. 9 illustrates the calculated magnitudes of the CJI force and the signal pressure for a core jam indicator 102 as described herein, coupled to an aluminum inner barrel 118, as a function of nominal barrel length of the inner barrel 118, at each of 350 gpm, 295 gpm, and 250 gpm flow rates of "average" drilling mud. As shown in FIG. 9, in such a configuration, the CJI force may increase linearly from about 5,000 N at a nominal barrel length of 30 ft. to a CJI force of about 47,000 N at a nominal barrel length of 360 ft. at a flow rate of 350 gpm. The CJI force may increase linearly from about 5,000 N at a nominal barrel length of 30 ft. to a CJI force of about 37,000 N at a nominal barrel length of 360 ft. at a flow rate of 295 gpm. The CJI force may increase linearly from about 5,000 N at a nominal barrel length of 30 ft. to a CJI force of about 31,000 N at a nominal barrel length of 360 ft. at a flow rate of 250 gpm. Additionally, in such a configuration, the pressure signal may be at least about 90 bar at a flow rate of about 350 gpm, at least about 62 bar at a flow rate of about 295 gpm, and at least about 46 bar at a flow rate of about 250 gpm.

Figure 10:
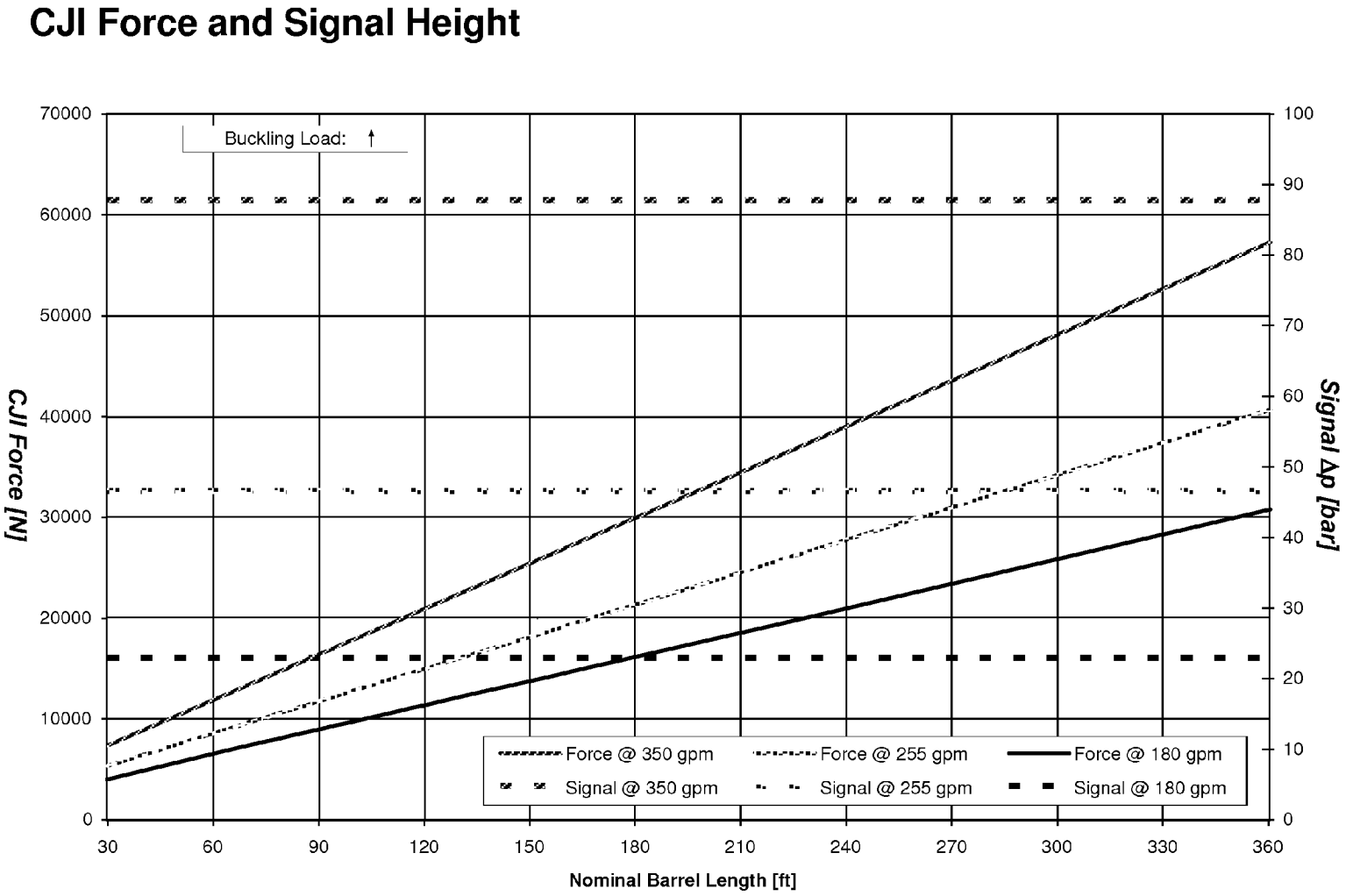
FIG. 10 is a graph illustrating the calculated magnitude of a core jam indication force and a calculated magnitude of a pressure signal generated by the core jam indicator as a function of a length of the inner barrel of the coring tool for an average drilling mud at three different rates of flow of the average drilling mud through the coring tool.

The graph of FIG. 10 illustrates the calculated magnitudes of the CJI force and the signal pressure for a core jam indicator 102 as described herein, coupled to a steel inner barrel 118, as a function of nominal barrel length of the inner barrel 118, at each of 350 gpm, 255 gpm, and 180 gpm flow rates of "average" drilling mud. As shown in FIG. 10, in such a configuration, the CJI force may increase linearly from about 7,000 N at a nominal barrel length of 30 ft. to a CJI force of about 55,000 N at a nominal barrel length of 360 ft. at a flow rate of 350 gpm. The CJI force may increase linearly from about 5,000 N at a nominal barrel length of 30 ft. to a CJI force of about 40,000 N at a nominal barrel length of 360 ft. at a flow rate of 255 gpm. The CJI force may increase linearly from about 5,000 N at a nominal barrel length of 30 ft. to a CJI force of about 30,000 N at a nominal barrel length of 360 ft. at a flow rate of 180 gpm. Additionally, in such a configuration, the pressure signal may be at least about 88 bar at a flow rate of about 350 gpm, at least about 47 bar at a flow rate of about 255 gpm, and at least about 22 bar at a flow rate of about 180 gpm.

Figure 11:
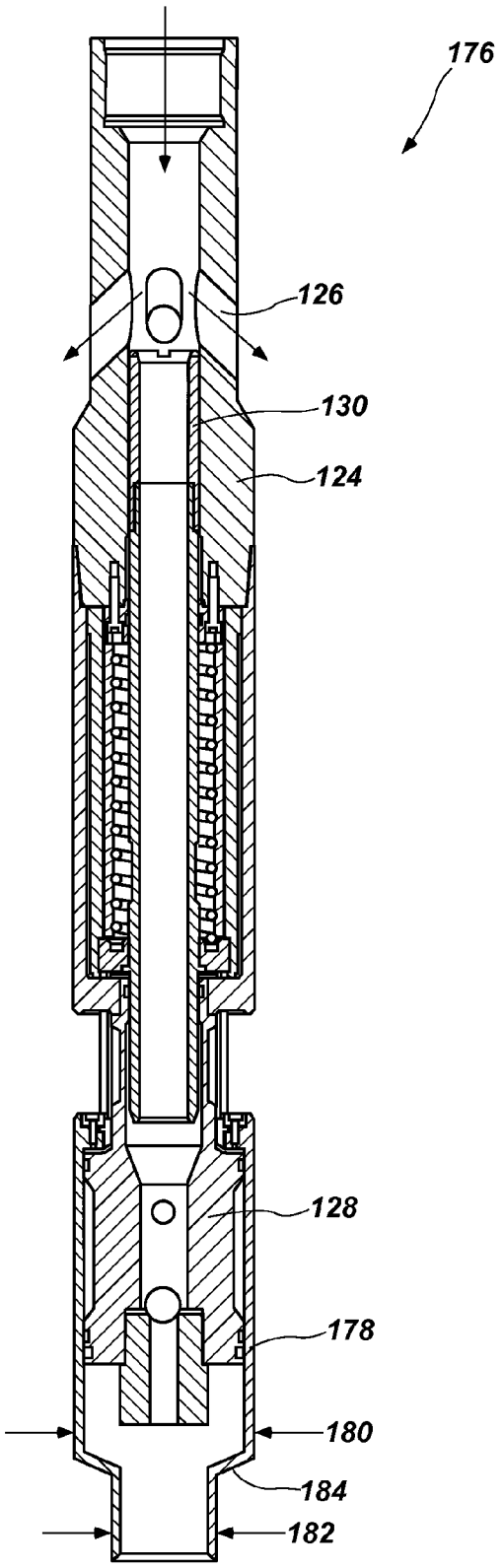
FIG. 11 is a side cross-sectional view of another embodiment of a core jam indicator.

FIG. 11 shows another embodiment of a core jam indicator 176. In this embodiment, the core jam indicator 176 includes a connector member 178 with a portion surrounding an anchor member 128 and having a first outside diameter 180. The connector member 178 also includes a portion with a second, smaller outside diameter 182 where the connector member 178 couples with an inner barrel 118 (FIG. 1) of a coring tool 100 (also FIG. 1). A pressure differential between fluid acting on the exterior of the connector member 178 and fluid within the connector member 178 may create a piston force acting on the connector member 178. In this embodiment, at the longitudinal location of a diameter reducing flange 184, the pressure acting on the interior of connector member 178 is lower than the pressure acting on the exterior of connector member 178 because some pressure is lost as the drilling mud flows along the exterior of connector member 178 and the exterior of the inner barrel 118 (FIG. 1). The diameter reducing flange 184 is configured such that the pressure in the interior of connector member 178 results in a force acting on the interior of the diameter reducing flange 184 that has a component in the downward direction in the context of FIG. 11. Similarly, the pressure acting on the exterior of connector member 178 results in a force component acting on the exterior of the diameter reducing flange 184 that has a component in the upward direction in the context of FIG. 11. Thus, a piston force resulting from the fluid pressure differential acting on the interior and exterior of the downhole facing surface 184 of the connector member 178 may result in a net force that has a component in the longitudinal upward direction. The downhole facing surface 184 may be configured so that the net force component in the longitudinal upward direction reduces the force required to activate the core jam indicator 176. By changing the relative sizes of the first outside diameter 180 and the second outside diameter 182 and consequently the relative sizes of surface 184, the net area over which the fluid pressure acts may be tailored to achieve a desired piston force acting on the connector member 178.

Figure 12:
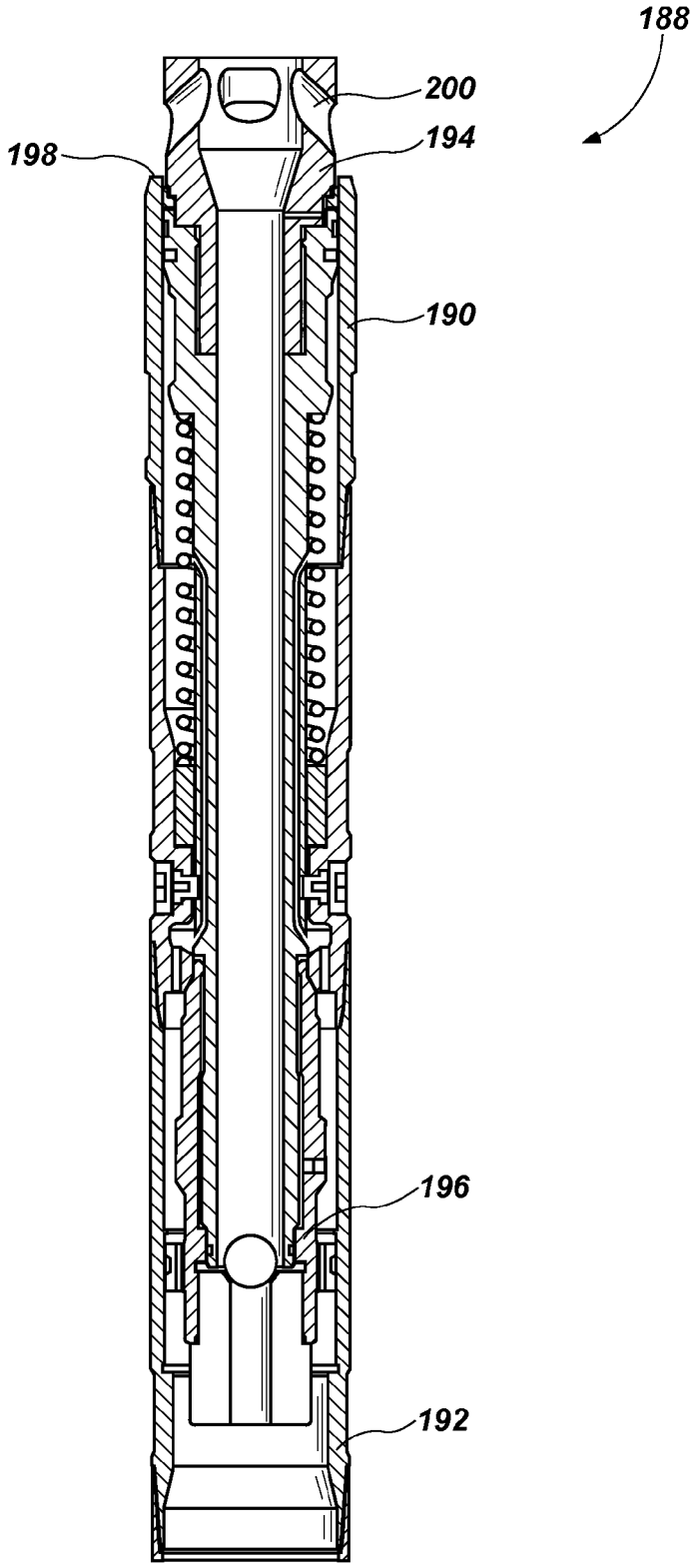
FIG. 12 is a side cross-sectional view of another embodiment of a core jam indicator.

Referring now to FIG. 12, another embodiment of a core jam indicator 188 may include a mandrel 190 and a connector member 192 disposed around a plug 194 and an anchor member 196. In this embodiment, the mandrel 190, when in an activated position, may at least partially cover fluid ports 200 from the exterior of plug 194 to impede fluid flow through the fluid ports 200, creating a pressure signal that can be detected at the surface of a drilling operation. Similar to the design shown in FIG. 2, the area against which a pressure differential acts against can be as small as the wall thickness of the mandrel 190, resulting in a relatively low force required to activate the core jam indicator 188. For example, a fluid pressure difference acting on an upper surface 198 of the mandrel 190 and the weight of the mandrel 190 and all parts that are connected to the mandrel 190 may urge the mandrel 190 to a deactivated position while the pressure acting on the corresponding lower surface (not shown) of the mandrel and the parts connected to it at a greater depth may urge the mandrel 190 to an activated position. The sum of these two forces may be a resulting force that urges the mandrel 190 to a deactivated position, i.e., a position in which the mandrel 190 facilitates fluid flow through ports 200 of the plug 194. If a core jam occurs and applies an additional force on the inner barrel in the upward direction, the additional force might exceed the relatively low force required to activate the core jam indicator 188, thus urging the mandrel 190 to an activated position, i.e., a position in which the mandrel 190 impedes fluid flow through ports 200 of the plug 194. In this embodiment, the surface area of the upper surface 198 may be smaller than a circular area defined by an outer diameter of the mandrel 190. For example, the upper surface 198 over which the fluid pressure acts to urge the mandrel 190 may comprise a surface area defined by a transverse cross-section of the mandrel 190.

Figure 13:
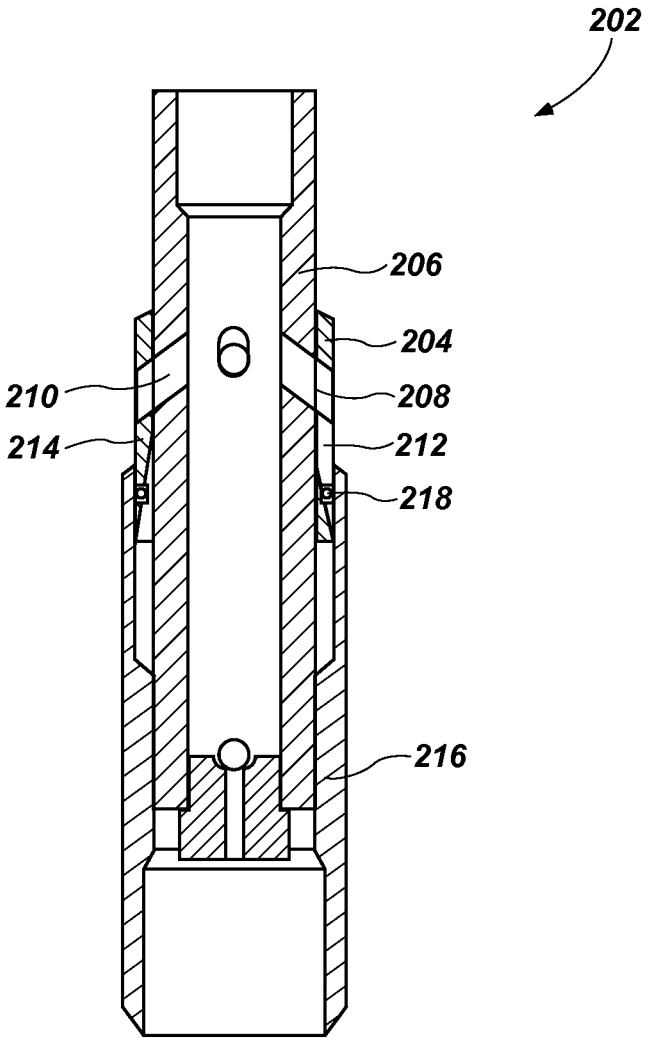
FIG. 13 is a side partial sectional view of another embodiment of a core jam indicator.

FIG. 13 shows another embodiment of a core jam indicator 202. The core jam indicator 202 may include a mandrel 204 configured to rotate about a plug 206. The mandrel 204 may include fluid ports 208. In one rotational position of the mandrel 204 with respect to the plug 206, the fluid ports 208 of the mandrel 204 may be aligned with fluid ports 210 in the plug 206. In another rotational position, the fluid ports 208 of the mandrel 204 may not be aligned with the fluid ports 210 in the plug 206, and the mandrel 204 may thus impede fluid flow through the fluid ports 210 in the plug 206.

The mandrel 204 may be configured to rotate in response to translational movement of an inner barrel 118 (FIG. 1) of a coring tool 100 (also FIG. 1). For example, the mandrel 204 may include one or more helical grooves, steps, or other features in an outer surface thereof. In this embodiment, the mandrel 204 includes helical grooves 212 in the outer surface 214. A connector member 216 may be coupled to the inner barrel 118 (FIG. 1). The connector member 216 may include one or more protrusions 218 engaged within the one or more helical grooves 212 of the mandrel 204. Alternatively, the one or more protrusions 218 may be included in the mandrel 204 and the one or more helical grooves 212 may be included in the connector member 216. During a coring operation under normal conditions, the fluid ports 208 of the mandrel 204 are aligned with the fluid ports 210 of the plug 206, facilitating fluid to flow through the plug 206 and the mandrel 204. A core jam within the inner barrel 118 (FIG. 1) may force the inner barrel 118 upward, causing the protrusions 218 to bear against the helical grooves 212 of the mandrel 204, causing the mandrel 204 to rotate relative to the plug 206. The ports 208 in the mandrel 204 may become misaligned with the ports 210 of the plug 206 and impede fluid flow through the plug 206. Fluid pressure within the plug 206 and along the drill string (not shown) may increase, and the core jam may be detected as a standpipe pressure increase at the surface of the drilling operation. This embodiment has the advantage that the mandrel 204 does not move in the longitudinal direction and thus does not need to act against any pressure difference above and below the mandrel 204.

While many elements of the core jam indicators 102, 176, 188, or 202 described herein are shown and described as individual parts, some elements may be pre-assembled or joined together as integral (e.g., unitary) parts. For example, in some embodiments, a mandrel 130, 190, or 204 may be formed integrally with a connector member 140, 178, 192, or 216. In some embodiments, the connector member 140, 178, 192, or 216 may be formed integrally with an inner barrel 118 (FIG. 1). In some embodiments, a plug 124, 194, or 206 may be formed integrally with an anchor member 128 or 196.

Additional, non-limiting embodiments within the scope of this disclosure include:

Embodiment 1

A core jam indicator for use with a coring tool for obtaining a core sample from a subterranean formation, the core jam indicator comprising: a plug coupled with an inner barrel, the plug being configured to selectively close the entrance of the inner barrel, the plug having at least one fluid port extending through a wall of the plug between an interior and an exterior of the plug; an anchor member operably associated with the plug; and a mandrel having an upper end and a lower end, the mandrel configured to move between a deactivated position and an activated position, the mandrel at least partially covering the at least one fluid port of the plug in the activated position to impede fluid flow through the at least one fluid port, the at least one fluid port being at least partially uncovered by the mandrel in the deactivated position to facilitate fluid flow through the at least one fluid port, the mandrel being coupled to the inner barrel of the coring tool such that movement of the inner barrel results in movement of the mandrel; wherein a piston force acting on the mandrel resulting from a pressure difference above and below the mandrel acts over an area smaller than a maximum transverse cross-sectional area of the inner barrel.

Embodiment 2

The core jam indicator of Embodiment 1, wherein the area over which the pressure difference acts is equal to or smaller than an area between an outer diameter of the inner barrel and an inner diameter of the mandrel.

Embodiment 3

The core jam indicator of Embodiment 2, wherein the area over which the pressure difference acts is equal to or smaller than an area between the outer diameter of the inner barrel and an inner diameter of the inner barrel.

Embodiment 4

The core jam indicator of Embodiment 3, wherein a total pressure difference above and below the mandrel is substantially equal to a hydrostatic pressure difference above and below the mandrel while drilling fluid is pumped through the core bit when the entrance to the inner barrel is closed.

Embodiment 5

The core jam indicator of any one of Embodiments 1 through 4, wherein at least a part of the outer diameter of the inner barrel decreases in the downhole direction.

Embodiment 6

The core jam indicator of any one of Embodiments 1 through 5, wherein the piston force acting on the mandrel includes a component of force urging the mandrel to the activated position equal or greater in magnitude to a component of force urging the mandrel to the deactivated position such that the net piston force acting on the mandrel resulting from the pressure difference above and below the mandrel is less than or equal to zero.

Embodiment 7

The core jam indicator of any one of Embodiments 1 through 6, wherein the mandrel is movable with respect to a ball seat surface that accepts a ball configured to block fluid flow through the inner barrel during a coring operation.

Embodiment 8

The core jam indicator of Embodiment 7, wherein the anchor member includes a main body and a pressure relief plug coupled to the main body, and a surface of the pressure relief plug comprises the ball seat surface.

Embodiment 9

The core jam indicator of any one of Embodiments 1 through 8, wherein the mandrel is configured to slide up and down between the activated position and the deactivated position responsive to movement of the inner barrel.

Embodiment 10

The core jam indicator of any one of Embodiments 1 through 9, wherein the mandrel is configured to rotate between the activated position and the deactivated position responsive to movement of the inner barrel.

Embodiment 11

The core jam indicator of any one of Embodiments 1 through 10, further comprising a spring member located and configured to bias the mandrel to the deactivated position.

Embodiment 12

The core jam indicator of Embodiment 11, wherein the spring member is disposed at least partly inside the mandrel.

Embodiment 13

The core jam indicator of any one of Embodiments 1 through 12, wherein the plug and the anchor member are formed integrally as a single component.

Embodiment 14

A coring tool for use in obtaining a core sample from an earth formation within a wellbore, comprising: a core bit; an outer tubular member coupled to the core bit and an inner barrel pivotally secured within the outer tubular member above the core bit, the inner barrel configured to receive a formation core sample therein as the core sample is formed by the core bit as the core bit drills through an earth formation; and a core jam indicator configured to generate a pressure signal detectable by an operator of the coring tool responsive to a jam between a formation core sample and the inner barrel as the core sample is formed by the core bit and received within the inner barrel, the core jam indicator comprising: a plug coupled with the inner barrel, the plug being configured to selectively close the entrance of the inner barrel, the plug having at least one fluid port extending through a wall of the plug between an interior and an exterior of the plug; an anchor member operatively associated with the plug; and a mandrel having an upper end and a lower end, the mandrel configured to move between a deactivated position and an activated position, the mandrel at least partially covering the at least one fluid port of the plug in the activated position to impede fluid flow through the at least one fluid port, the at least one fluid port being at least partially uncovered by the mandrel in the deactivated position to facilitate fluid flow through the at least one fluid port, the mandrel being coupled to an inner barrel of the coring tool such that movement of the inner barrel results in movement of the mandrel; wherein a piston force acting on the mandrel resulting from a pressure difference above and below the mandrel acts over an area smaller than a maximum transverse cross-sectional area of the inner barrel.

Embodiment 15

The coring tool of Embodiment 14, wherein the outer barrel is coupled to a rotatable outer member of a swivel assembly, and wherein the plug of the core jam indicator is coupled to a substantially stationary inner member of a swivel assembly.

Embodiment 16

A method of forming a core jam indicator for use with a coring tool for obtaining a core sample from a subterranean formation, the method comprising: coupling a plug with an inner barrel, the plug having at least one fluid port extending through a wall of the plug between an interior and an exterior of the plug; operatively associating an anchor member with the inner barrel; disposing a mandrel proximate the plug, the mandrel having an upper end and a lower end, the mandrel configured to move between a deactivated position and an activated position, the mandrel at least partly covering the at least one fluid port of the plug in the activated position to impede fluid flow through the at least one fluid port, the at least one fluid port of the tubular plug being at least partly uncovered by the mandrel in the deactivated position to facilitate fluid flow through the at least one fluid port; and coupling an inner barrel of a coring tool to the mandrel such that movement of the inner barrel results in movement of the mandrel from the deactivated position to the activated position, restriction of fluid flow through the at least one fluid port extending through the wall of the plug, and an increase in a hydraulic pressure within the plug.

Embodiment 17

The method of Embodiment 16, further comprising configuring the core jam indicator such that the increase in the hydraulic pressure within the plug does not result in application of a piston force on the mandrel toward the deactivated position.

Embodiment 18

The method of Embodiment 16 or Embodiment 17, further comprising forming a fluid passageway extending through the core jam indicator through the interior of each of the plug, the mandrel, and the anchor member.

Embodiment 19

The method of any one of Embodiments 16 through 18, further comprising configuring the core jam indicator such that a piston force acting on the mandrel urging the mandrel to the deactivated position resulting from a pressure difference above and below the mandrel when the mandrel is in the activated position acts over an area smaller than a maximum transverse cross-sectional area of the inner barrel.

Embodiment 20

The method of Embodiment 19, further comprising configuring the core jam indicator such that the area over which the pressure difference acts is equal to or smaller than an area between an outer diameter of the inner barrel and an inner diameter of the mandrel.

While certain illustrative embodiments have been described in connection with the figures, those of ordinary skill in the art will recognize and appreciate that the scope of this disclosure is not limited to those embodiments explicitly shown and described herein. Rather, many additions, deletions, and modifications to the embodiments described herein may be made to produce embodiments within the scope of this disclosure, such as those hereinafter claimed, including legal equivalents. In addition, features from one disclosed embodiment may be combined with features of another disclosed embodiment while still being within the scope of this disclosure, as contemplated by the inventors.

What is claimed is:

1. A core jam indicator for use with a coring tool for obtaining a core sample from a subterranean formation, the core jam indicator comprising:

a plug coupled with an inner barrel, the plug being configured to selectively close the entrance of the inner barrel, the plug having at least one fluid port extending through a wall of the plug between an interior and an exterior of the plug;

an anchor member operably associated with the plug; and a mandrel having an upper end and a lower end, the mandrel configured to move between a deactivated position and an activated position, the mandrel at least partially covering the at least one fluid port of the plug in the activated position to impede fluid flow through the at least one fluid port, the at least one fluid port being at least partially uncovered by the mandrel in the deactivated position to facilitate fluid flow through the at least one fluid port, the mandrel being coupled to the inner barrel of the coring tool such that movement of the inner barrel results in movement of the mandrel;

wherein a piston force acting on the mandrel resulting from a pressure difference above and below the mandrel acts over an area smaller than a maximum transverse cross-sectional area of the inner barrel.

2. The core jam indicator of claim 1, wherein the area over which the pressure difference acts is equal to or smaller than an area between an outer diameter of the inner barrel and an inner diameter of the mandrel.

3. The core jam indicator of claim 2, wherein the area over which the pressure difference acts is equal to or smaller than an area between the outer diameter of the inner barrel and an inner diameter of the inner barrel.

4. The core jam indicator of claim 3, wherein the pressure difference above and below the mandrel is substantially equal to a hydrostatic pressure difference above and below the mandrel while drilling fluid is pumped through a core bit when the entrance to the inner barrel is closed.

5. The core jam indicator of claim 1, wherein at least a part of the outer diameter of the inner barrel decreases in the downhole direction.

6. The core jam indicator of claim 1, wherein the piston force acting on the mandrel includes a first component of force urging the mandrel to the activated position equal or greater in magnitude to a second component of force urging the mandrel to the deactivated position such that the piston force, calculated by summing the first and second components of force, acting on the mandrel resulting from the pressure difference above and below the mandrel is less than or equal to zero.

7. The core jam indicator of claim 1, wherein the mandrel is movable with respect to a ball seat surface that accepts a ball configured to block fluid flow through the inner barrel during a coring operation.

8. The core jam indicator of claim 7, wherein the anchor member includes a main body and a pressure relief plug coupled to the main body, and a surface of the pressure relief plug comprises the ball seat surface.

9. The core jam indicator of claim 1, wherein the mandrel is configured to slide up and down between the activated position and the deactivated position responsive to movement of the inner barrel.

10. The core jam indicator of claim 1, wherein the mandrel is configured to rotate between the activated position and the deactivated position responsive to movement of the inner barrel.

11. The core jam indicator of claim 1, further comprising a spring member located and configured to bias the mandrel to the deactivated position.

12. The core jam indicator of claim 11, wherein the spring member is disposed at least partly inside the mandrel.

13. The core jam indicator of claim 1, wherein the plug and the anchor member are formed integrally as a single component.

14. A coring tool for use in obtaining a core sample from an earth formation within a wellbore, comprising:

a core bit;

an outer tubular member coupled to the core bit and an inner barrel pivotally secured within the outer tubular member above the core bit, the inner barrel configured to receive the core sample therein as the core sample is formed by the core bit as the core bit drills through the earth formation; and a core jam indicator configured to generate a pressure signal detectable by an operator of the coring tool responsive to a jam between the core sample and the inner barrel as the core sample is formed by the core bit and received within the inner barrel, the core jam indicator comprising:

a plug coupled with the inner barrel, the plug being configured to selectively close the entrance of the inner barrel, the plug having at least one fluid port extending through a wall of the plug between an interior and an exterior of the plug;

an anchor member operatively associated with the plug; and a mandrel having an upper end and a lower end, the mandrel configured to move between a deactivated position and an activated position, the mandrel at least partially covering the at least one fluid port of the plug in the activated position to impede fluid flow through the at least one fluid port, the at least one fluid port being at least partially uncovered by the mandrel in the deactivated position to facilitate fluid flow through the at least one fluid port, the mandrel being coupled to the inner barrel of the coring tool such that movement of the inner barrel results in movement of the mandrel;

wherein a piston force acting on the mandrel resulting from a pressure difference above and below the mandrel acts over an area smaller than a maximum transverse cross-sectional area of the inner barrel.

15. The coring tool of claim 14, wherein the outer barrel is coupled to a rotatable outer member of a swivel assembly, and wherein the plug of the core jam indicator is coupled to a substantially stationary inner member of the swivel assembly.

16. A method of forming a core jam indicator for use with a coring tool for obtaining a core sample from a subterranean formation, the method comprising:

coupling a plug with an inner barrel, the plug having at least one fluid port extending through a wall of the plug between an interior and an exterior of the plug;

operatively associating an anchor member with the inner barrel;

disposing a mandrel proximate the plug, the mandrel having an upper end and a lower end, the mandrel configured to move between a deactivated position and an activated position, the mandrel at least partly covering the at least one fluid port of the plug in the activated position to impede fluid flow through the at least one fluid port, the at least one fluid port of the plug being at least partly uncovered by the mandrel in the deactivated position to facilitate fluid flow through the at least one fluid port; and coupling the inner barrel of the coring tool to the mandrel such that movement of the inner barrel results in movement of the mandrel from the deactivated position to the activated position, restriction of fluid flow through the at least one fluid port extending through the wall of the plug, and an increase in a hydraulic pressure within the plug.

17. The method of claim 16, further comprising configuring the core jam indicator such that the increase in the hydraulic pressure within the plug does not result in application of a piston force on the mandrel toward the deactivated position.

18. The method of claim 16, further comprising forming a fluid passageway extending through the core jam indicator through the interior of each of the plug, the mandrel, and the anchor member.

19. The method of claim 16, further comprising configuring the core jam indicator such that a piston force acting on the mandrel urging the mandrel to the deactivated position resulting from a pressure difference above and below the mandrel when the mandrel is in the activated position acts over an area smaller than a maximum transverse cross-sectional area of the inner barrel.

20. The method of claim 19, further comprising configuring the core jam indicator such that the area over which the pressure difference acts is equal to or smaller than an area between an outer diameter of the inner barrel and an inner diameter of the mandrel.

* * * * *